US006578545B1

(12) United States Patent
Hultquist et al.

(10) Patent No.: US 6,578,545 B1
(45) Date of Patent: Jun. 17, 2003

(54) METHOD AND APPARATUS FOR FUEL INJECTION IN AN INTERNAL COMBUSTION ENGINE, AND INTERNAL COMBUSTION ENGINE

(75) Inventors: Anders Hultquist, Malmo (SE); Christer Hedström, Gothenburg (SE)

(73) Assignee: Scania CV AB (Publ) (SE)

( * ) Notice: Subject to any disclaimer, the term of this patent is extended or adjusted under 35 U.S.C. 154(b) by 0 days.

(21) Appl. No.: 09/856,226

(22) PCT Filed: Nov. 17, 1999

(86) PCT No.: PCT/SE99/02101

§ 371 (c)(1),
(2), (4) Date: May 18, 2001

(87) PCT Pub. No.: WO00/31408

PCT Pub. Date: Jun. 2, 2000

(30) Foreign Application Priority Data

Nov. 19, 1998 (SE) ..... 9803950

(51) Int. Cl.[7] ..... F02B 3/10
(52) U.S. Cl. ..... 123/299; 123/305
(58) Field of Search ..... 123/299, 305; 701/105

(56) References Cited

U.S. PATENT DOCUMENTS

| | | | | |
|---|---|---|---|---|
| 5,794,585 | A | 8/1998 | Yonezawa et al. | 123/299 |
| 6,032,641 | A * | 3/2000 | Aketa et al. | 123/299 |
| 6,058,348 | A * | 5/2000 | Ohyama et al. | 701/103 |
| 6,125,816 | A * | 10/2000 | Inoue | 123/299 |
| 2001/0022168 | A1 * | 9/2001 | Teraji et al. | 123/295 |
| 2002/0148435 | A1 * | 10/2002 | Kohketsu et al. | 123/299 |

FOREIGN PATENT DOCUMENTS

| | | |
|---|---|---|
| EP | 0859148 | 8/1998 |
| EP | 0869269 | 10/1998 |

* cited by examiner

*Primary Examiner*—Erick Solis
(74) *Attorney, Agent, or Firm*—Ostrolenk, Faber, Gerb & Soffen, LLP

(57) ABSTRACT

A method for injection of fuel into a cylinder for a combustion engine is distinguished by the fact that the fuel is injected into the cylinder in the region (10) of the piston's upper dead centre point (8) in the gas exchange stroke (4, 5), when the fuel is injected into the hot exhaust gases in order readily to be able to be vaporised and form a homogenous fuel/air mixture which can be ignited by compression the next time the piston approaches the upper dead centre position. The invention relates also to an arrangement for implementing the method and an engine incorporating such arrangement.

23 Claims, 2 Drawing Sheets

METHOD AND APPARATUS FOR FUEL INJECTION IN AN INTERNAL COMBUSTION ENGINE, AND INTERNAL COMBUSTION ENGINE

FIELD OF INVENTION

The present invention relates to a method and an arrangement for injection of fuel into a cylinder of a combustion engine, and to a combustion engine of the type known inter alia under the designation ATAC (Active Thermic Atmospheric Combustion) or HCCI (Homogeneous Charge Compression Ignition).

STATE OF THE ART

A problem with conventional diesel engines is that they produce high emissions of nitrogen oxides (NOx), as a result of very high combustion temperatures in limited portions of the cylinders. ATAC or HCCI engines are intended to avoid these emission problems and may popularly be described as a combustion of diesel engine and Otto engine. In their case, a premixed fuel/air mixture is introduced into the cylinder and is ignited by compression when the working piston is in the vicinity of its upper dead center position in the ignition phase. The advantages of ATAC engines include producing little or no NOx emissions and exhibiting a high degree of efficiency close to that of conventional diesel engines. ATAC engines avoid the problem described above partly by using a lean mixture resulting in lower combustion temperatures and partly because combustion is initiated substantially simultaneously within widespread regions of the combustion chamber. The total result is more even temperature distribution without very high combustion temperatures in portions of the combustion chamber.

PROBLEM WITH THE STATE OF THE ART

However, achieving a relatively homogeneous premixed fuel/air mixture involves particular expedients in the engine and extra components in the intake system as compared with a conventional diesel engine, thereby making ATAC engines more expensive and more complicated. It has also been found to be difficult effectively to achieve homogeneous mixing, particularly when using conventional diesel fuel. The technique employed has in particular easily resulted in drops of fuel which are too large and settle on the walls of the combustion chamber causing bad fuel economy and high emissions of unburnt fuel.

OBJECTS AND MOST IMPORTANT CHARACTERISTICS OF THE INVENTION

One object of the present invention is to avoid the problem of the state of the art and to indicate a simpler and more economic and effective solution.

This is achieved with a method and an arrangement of the kind mentioned in the introduction. Air and fuel are mixed and ignited by compression. Substantially all of the fuel is injected into the engine cylinder in the region of the upper dead center point of the piston in the gas exchange stroke.

The result arrived at in a simple and advantageous manner is a homogeneous mixture of fuel and air, as the injection of the fuel takes place during a phase when hot residual gasses from previous combustion cycles are still in the cylinder, thereby promoting vaporization of the injected fuel. During the induction or intake stroke, the air drawn in (or fed in) becomes effectively mixed with the vaporized or at least substantially vaporized fuel so that a homogeneous fuel/air mixture is formed throughout the combustion chamber. After the induction stroke, compression takes place in a conventional manner, followed by ignition in the region of the upper dead center point in the compression stroke.

The engine is thus afforded advantages pertaining to homogenous combustion without having to adopt expedients which are necessary in ATAC engines. For example, no separate mixing chamber is required. On the contrary, the engine's conventional injection system can be used with modified control of injection. More effective homogenization of the fuel/air mixture is also achieved. Injection control can be exercised by means of the engine's computer system and injection can be physically effected by means of conventional mechanical, electrical, pneumatic or hydraulic devices intended for fuel injection in combustion engines.

According to an advantageous embodiment of the invention, all the fuel is injected into the cylinder in the region of the piston's upper dead center point in the gas exchange stroke in the hot residual exhaust gases, which means that the fuel becomes properly mixed in the cylinder before being subjected to combustion.

Further characteristics and advantages of the invention are indicated in the example described below with reference to the attached drawing.

DESCRIPTION OF AN EMBODIMENT

Figure 1:
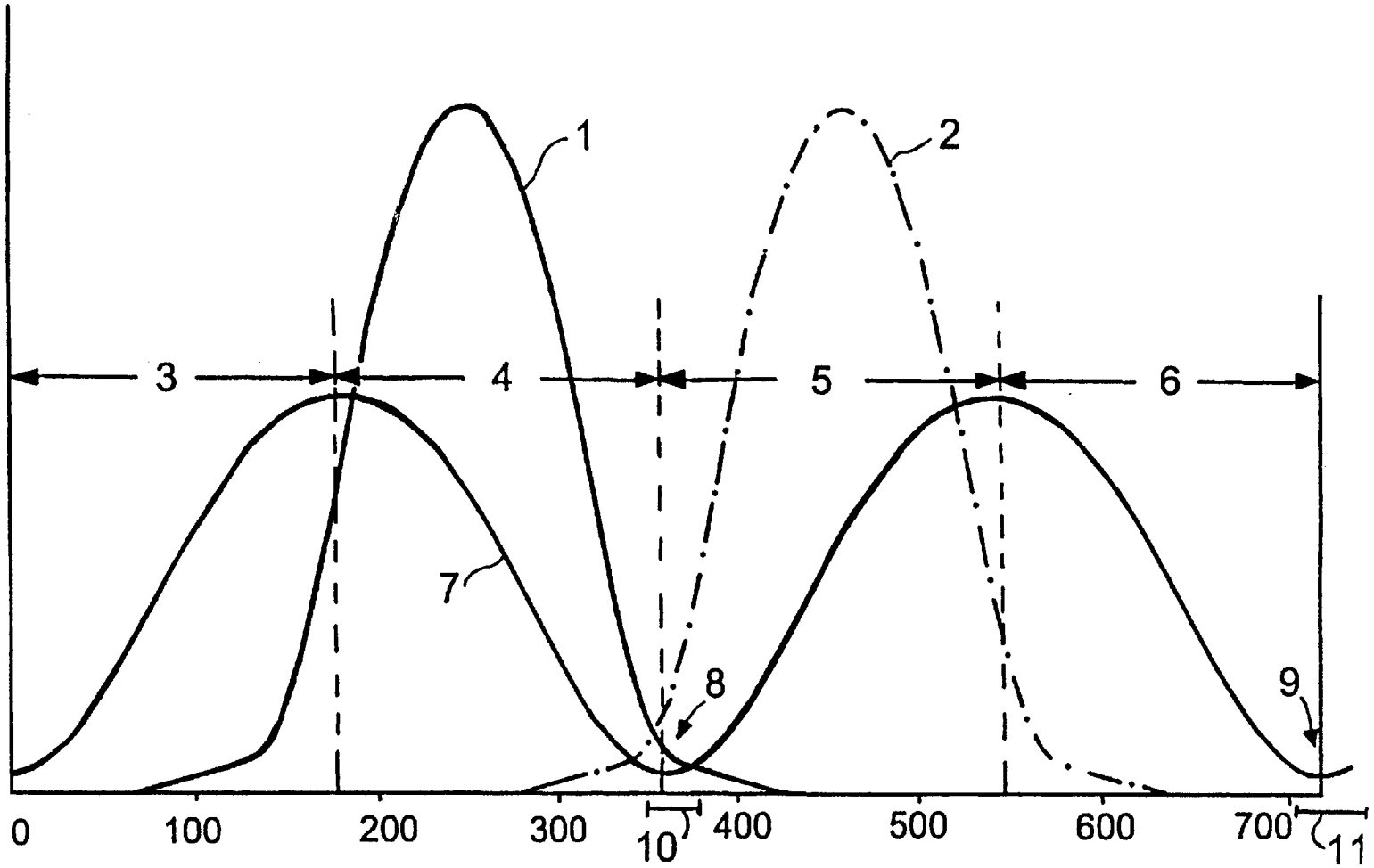
FIG. 1 illustrates in diagram form how various engine parameters interact during a working cycle, such as valve curves for exhaust valves and inlet valves, and instantaneous volume as a function of crankshaft rotation in degrees, with indication of positions for fuel injection along the bottom of the diagram.

The curves depicted in FIG. 1 represent how various parameters interact in a combustion engine according to the invention. The combustion engine is a multi-cylinder piston engine which is used, for example, to drive a heavy-duty vehicle and works like a so-called ATAC engine in which air and fuel are mixed and are ignited by compression ignition. As all the cylinders work in a similar manner, only one cylinder is shown in FIG. 2, and FIG. 1 illustrates only the pattern which occurs in one of the cylinders during a working cycle.

Figure 2:
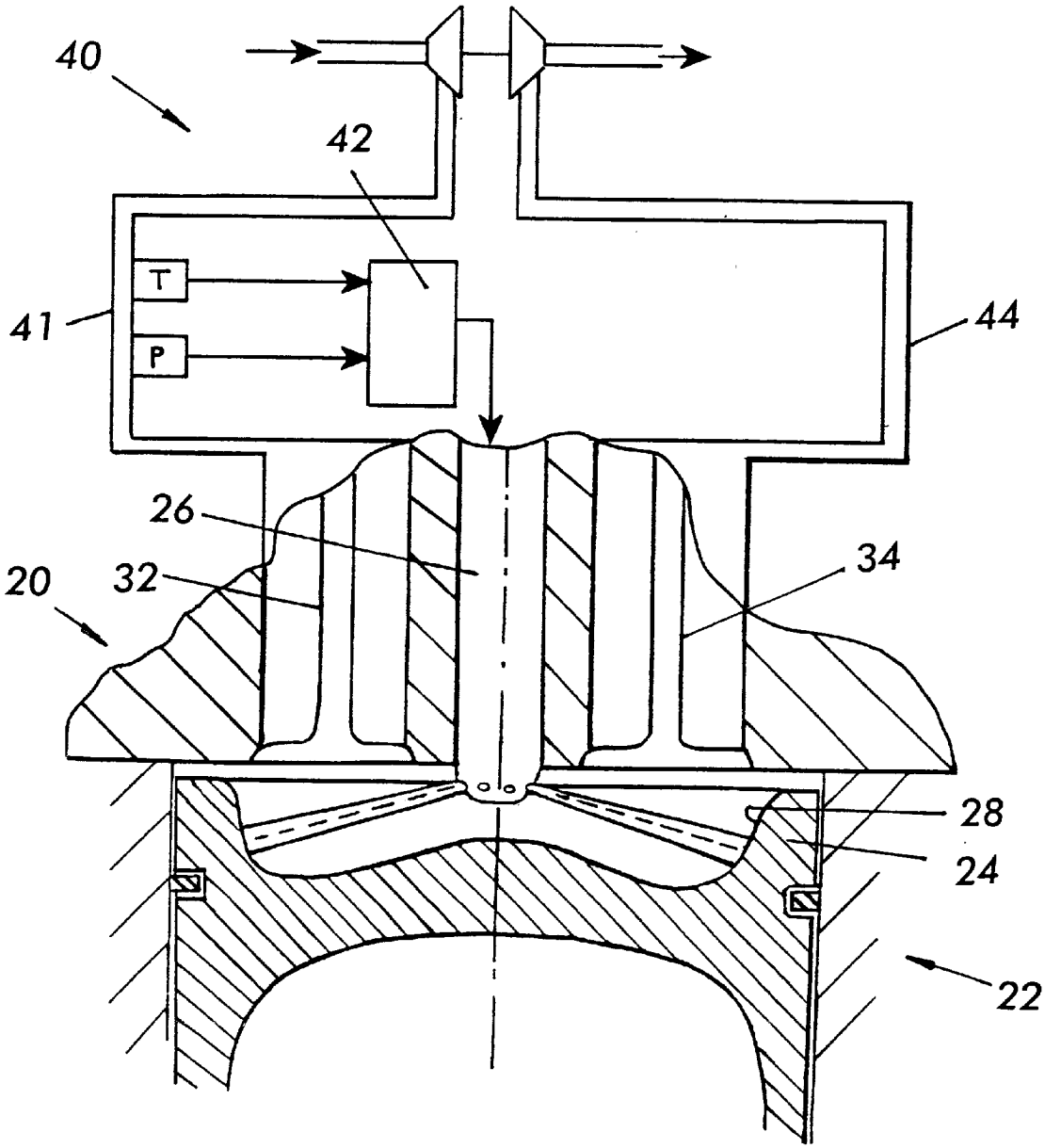
FIG. 2 is a partial schematic drawing of an engine provided with the invention, showing a cross-section of a cylinder and piston in the engine.

Referring to FIG. 2, a fragment of an engine 20 is illustrated, showing one cylinder 22 of a multi-cylinder engine 20. There is a reciprocating piston 24 movable through the cylinder in the usual manner. There is a central fuel injector 26 that injects into a cavity 28 defined in the top end of the piston 24. The usual inlet valve 32 to and outlet valve 34 from the cylinder are provided.

The engine 20 includes a turbo compressor unit 40, including a turbo compressor and a turbine. On the inlet side, there is a sensor T for sensing temperature and a sensor P for sensing pressure of the inlet air along the inlet path 41 into the inlet valve 32. The sensors T and P are connected to a control system 42 for the fuel injector. Exhaust from the valve 34 is out the outlet path 44 through the compressor unit.

FIG. 1 shows a valve curve 1 for the exhaust valve and a valve curve 2 for the inlet valve. The horizontal axis represents time and is divided into the usual strokes of a four-stroke engine, i.e. working stroke 3, exhaust stroke 4, induction stroke 5 and compression stroke 6, of which the exhaust stroke 4 and the induction stroke 5 together constitute the gas exchange stroke. The horizontal axis is graduated from 0 to 720 degrees corresponding to two complete turns of the engine's crankshaft during a working cycle.

In the diagram, the curve 7 denotes the instataneous volume as a function of time, and the point 8 on the curve indicates the piston's upper dead center piont (smallest volume of combustion chamber) in the gas exchange stroke, while the point 9 indicates the piston's upper dead center point in the ignition phase. The interval 10 indicates the period for injection of fuel during the gas exchange stroke, thereby, as described above, affording advantages as mentioned above. The fuel is thus injected at the end of the exhaust stroke 4 and/or during the beginning of the induction stroke 5 when the cylinder contains a high proportion of hot exhaust gases from previous combustion, thereby facilitating the vaporization of the injected fuel. The interval 11 indicates the period of conventional injection of the fuel at the upper dead center point for the ignition situation, which is thus about 360 degrees later. As the valve curves 1,2 indicate, there is in thes case a certain overlap between the closing of the exhaust valve and opening of the inlet valve. This may vary from engine to engine and in some cases there is no such overlap. Fuel injection takes place not instantaneously but durning a certain number of crank angle degres, normally a maximum of about 20 crank angle degrees. A certain overlap is also tolerable between the open exhaust valve and the fuel injection, i.e. fuel injection may be initiated before the exhaust valve has closed without unburnt fuel making its way out of the exhaust valve. The timing of fuel injection is controlled so as to ensure that the fuel is injected so close to the piston's upper dead center point that there is no risk of fuel reaching the cylinder liner. Should fuel be injected also during part of the induction phase, when the cylinder line is exposed, the resulting cooling would reduce the potential for vaporizing the fuel. In practice the injection may therefor take place so long as the spray of fuel does not reach the cylinder liner and before the inlet valve has opened too far. A further aspect of this is that drops of fuel on the cylinder liner would probably not be fully involved in combustion, thereby causing undersiable emissions of carbon and bad fuel economy.

However, vaporization takes place for a certain time after injection, during at least part of the induction stroke, and, depending on the application and the parameters, at least some vaporization may take place as late as in the region of half of the induction phase.

The injection has to be effected so that the spray of fuel drops is directed downwards into a hollow situated in the top of the piston so that the heat of the piston is also used for promoting vaporisation.

The compression is adapted to the fuel and in the case of diesel oil the compression ratio is preferably between about 9:1 and 14:1, whereas other compression ratios are more advantageous in cases where other fuels are used.

The example illustrated in the diagram of FIG. 1 relates to an embodiment of the invention in which all or substantially all of the fuel is injected at the upper dead center point in the gas exchange stroke during the period marked 10. In alternative embodiments it is possible that only part of the fuel is injected during the specific time 10, while the remainder of the fuel is injected at a later time. In that case, a second portion of fuel may advantageously be injected into the cylinder in the region of the piston's upper dead center point 9 at the end of the compression stroke 6 during the more conventional injection period 11.

The first portion of the fuel which is injected during the specific time mentioned comprises, in all circumstances, more than 50% of the total amount of fuel and it is advantageous that it should also exceed 95% of the total amount of fuel. It follows that the second portion of the fuel is always less than 50% and is with advantage less than 5% of the total amount of fuel.

Finally, it should be noted that the initiation of ignition in a combustion engine according to the invention has to be controlled accurately. This may be achieved, for example, by controlling the engine's inlet pressure, which in the case of a supercharged engine is the same as the engine's charging pressure, and/or by controlling the inlet air temperature.

The ignition of the fuel mixture has to be by compression ignition in the same manner as for a conventional diesel engine, and in this respect the engine may be regarded as being a diesel engine.

What is claimed is:

1. A method for operating an ATAC engine, wherein there is a piston which is movable in a cylinder to an upper dead center point of the piston and is movable down from the upper dead center point, the method comprising the steps of:

moving the piston through the cylinder in a plurality of piston strokes, including a compression stroke to the upper dead center point of the piston;

allowing the fuel to self-ignite after the compression stroke;

thereafter moving the piston through a down stroke caused by the ignition;

thereafter moving the piston through an exhaust stroke to the upper dead center point of the piston;

thereafter moving the piston through an intake stroke, the exhaust stroke and the intake stroke together constituting a gas exchange stroke; and inserting air and injecting substantially all the fuel into the cylinder in the region of the upper dead center point of the piston during the gas exchange stroke to mix the fuel with the air.

2. The method of claim 1, wherein all of the fuel is injected into the cylinder in the region of the upper dead center point of the piston during the gas exchange stroke.

3. The method of claim 1, wherein a second portion of the fuel which was not injected into the cylinder in the region of the upper dead center point of the piston during the gas exchange stroke is injected into the cylinder at the end of the compression stroke.

4. The method of claim 3, further comprising controlling the pressure in the cylinder during ignition of the fuel by controlling the pressure of the air inserted into the cylinder to be mixed with the fuel.

5. The method of claim 1, further comprising controlling the pressure in the cylinder during ignition of the fuel by controlling the pressure of the air inserted into the cylinder to be mixed with the fuel.

6. The method of claim 3, further comprising controlling the pressure in the cylinder during ignition by controlling the temperature of the air being inserted to mix with the fuel in the cylinder.

7. The method of claim 1, further comprising controlling the pressure in the cylinder during ignition by controlling the temperature of the air being inserted to mix with the fuel in the cylinder.

8. The method of claim 1, further comprising igniting the fuel in the cylinder in the region of the upper dead center point of the piston by compression ignition.

9. The method of claim 1, wherein the fuel comprises diesel oil and the piston is movable in the cylinder through the piston strokes, and the piston and cylinder are so shaped that the compression in the cylinder in the region of the upper dead center point of the piston during the ignition is selected to be within the range of approximately 9:1 to 14:1.

10. The method of claim 1, wherein the fuel is injected during an interval which overlaps the end of the exhaust stroke and the beginning of the intake stroke.

11. The method of claim 10, wherein the injection interval comprises a maximum of approximately 20 crank angle degrees.

12. The method of claim 1, wherein the fuel is injected during an interval at the end of the exhaust stroke before the beginning of the intake stroke.

13. An ATAC engine comprising:

a plurality of cylinders each having a piston movable therein, and each including an intake valve, an exhaust valve and a fuel injector the valves being operative in relation to movement of the piston to define a plurality of piston strokes, including:

a compression stroke to the upper dead center point of the piston, followed by a working stroke resulting from ignition of fuel at the end of the compression stroke, followed by an exhaust stroke to the upper dead center point of the piston, followed by an intake stroke, the exhaust stroke and the intake stroke together constituting a gas exchange stroke, the intake valve being operative to admit air to the cylinder during the intake stroke; and a controller for the fuel injector operative to inject substantially all the fuel into the cylinder in the region of the upper dead center point of the piston during the gas exchange stroke to mix the fuel with the air admitted through the intake valve, whereby the fuel-air mixture in the cylinder self-ignites at the end of the compression stroke.

14. The engine of claim 13, wherein the fuel is injected during an interval which overlaps the end of the exhaust stroke and the beginning of the intake stroke.

15. The engine of claim 14, wherein the injection interval comprises a maximum of approximately 20 crank angle degrees.

16. The engine of claim 13, wherein the fuel is injected during an interval at the end of the exhaust stroke before the beginning of the intake stroke.

17. The engine of claim 13, wherein the controller for the fuel injector is operable to inject the whole amount of the fuel into the cylinder in the region of the upper dead center point of the piston during the gas exchange stroke.

18. The engine of claim 13, wherein the injector is operable for delivering a second portion of the fuel to be injected into the cylinder in the region of the upper dead center point of the piston at the end of the compression stroke.

19. The engine of claim 13, further comprising an air insertion device connected with the cylinder for controlling the pressure in the cylinder during ignition of the fuel by controlling the pressure of the air inserted into the cylinder.

20. The engine of claim 13, further comprising a device for controlling the temperature of the air being inserted into the cylinder for controlling the pressure in the cylinder during ignition.

21. The engine of claim 13, wherein the fuel injected into the cylinder is adapted to be ignited by compression ignition and the stroke of the piston with respect to the cylinder is such that the fuel mixed with air will be ignited by compression ignition when the piston moves to the upper dead center point during the compression stroke.

22. The engine of claim 13, wherein the fuel comprises diesel oil and the piston is so movable in the cylinder and the piston and cylinder are so shaped that the compression in the cylinder in the region of the upper dead center point of the piston during the ignition is selected to be within the range of approximately 9:1 to 14:1.

23. The engine of claim 13, wherein the piston has a top side facing into the cylinder with a hollow formed in the top of the piston; the device for injecting fuel into the cylinder comprises an injection orifice situated in the cylinder and the injection orifice being directed to spray fuel into the hollow in the top of the piston for injecting fuel into the cylinder.

* * * * *